US009897351B2

(12) United States Patent
Kim et al.

(10) Patent No.: US 9,897,351 B2
(45) Date of Patent: Feb. 20, 2018

(54) AIR CONDITIONER

(71) Applicant: LG ELECTRONICS INC., Seoul (KR)

(72) Inventors: Donghwi Kim, Seoul (KR); Ilyoong Shin, Seoul (KR); Junseong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 14/712,600

(22) Filed: May 14, 2015

(65) Prior Publication Data

US 2016/0033179 A1 Feb. 4, 2016

(30) Foreign Application Priority Data

Aug. 1, 2014 (KR) ..... 10-2014-0099194

(51) Int. Cl.
*F25B 30/02* (2006.01)
*F25B 39/00* (2006.01)
(Continued)

(52) U.S. Cl.
CPC ..... *F25B 30/02* (2013.01); *F24F 1/14* (2013.01); *F24F 1/30* (2013.01); *F25B 13/00* (2013.01);
(Continued)

(58) Field of Classification Search
CPC ..... F25B 30/02; F25B 39/00; F25B 13/00; F25B 2313/025; F25B 2313/02533;
(Continued)

(56) References Cited

U.S. PATENT DOCUMENTS 2,148,415 A * 2/1939 Labberton ..... F25B 13/00 165/265
2,785,540 A * 3/1957 Biehn ..... F25B 13/00 62/159
(Continued)

FOREIGN PATENT DOCUMENTS

EP 2 204 625 A1 7/2010
EP 2 455 689 A2 5/2012
(Continued)

*Primary Examiner* — Len Tran
*Assistant Examiner* — Kirstin Oswald
(74) *Attorney, Agent, or Firm* — Birch, Stewart, Kolasch & Birch, LLP

(57) ABSTRACT

An air conditioner includes a compressor, a flow switching part, an outdoor heat exchanger including a plurality of refrigerant tubes for guiding the refrigerant heat exchanged with outdoor air, a main expansion valve disposed at one side of the outdoor heat exchanger, a first inlet/outlet tube extending from the flow switching part to the outdoor heat exchanger, and a second inlet/outlet tube extending from the outdoor heat exchanger to the main expansion valve. The outdoor heat exchanger includes a header defining a flow space for the refrigerant, the header including an upper header and a lower header, a check valve disposed between the upper header and the lower header to guide the refrigerant to flow in one direction, and a bypass tube extending from the lower header to the second inlet/outlet tube to guide a discharge of a liquid refrigerant existing in the lower header.

19 Claims, 4 Drawing Sheets

(51) Int. Cl.

| | |
|---|---|
| ***F28D 1/02*** | (2006.01) |
| ***F25B 13/00*** | (2006.01) |
| ***F24F 1/14*** | (2011.01) |
| ***F24F 1/30*** | (2011.01) |
| ***F28F 17/00*** | (2006.01) |
| ***F28D 1/047*** | (2006.01) |
| *F25B 39/02* | (2006.01) |
| *F25B 41/00* | (2006.01) |
| *F28F 9/02* | (2006.01) |

(52) U.S. Cl.
CPC ..... *F25B 39/00* (2013.01); *F28D 1/0233* (2013.01); *F28D 1/0477* (2013.01); *F28F 17/005* (2013.01); *F25B 39/028* (2013.01); *F25B 41/003* (2013.01); *F25B 2313/025* (2013.01); *F25B 2313/02533* (2013.01); *F25B 2313/02541* (2013.01); *F25B 2400/075* (2013.01); *F25B 2400/13* (2013.01); *F28F 9/0275* (2013.01)

(58) Field of Classification Search
CPC ..... F25B 2313/02541; F25B 2400/075; F25B 2400/13; F25B 9/0275; F28F 17/005; F28F 9/0275; F28D 1/0477; F28D 1/0233; F24F 1/30; F24F 1/14
USPC ..... 62/324.6; 165/143
See application file for complete search history.

(56) References Cited

U.S. PATENT DOCUMENTS

| | | | | | |
|---|---|---|---|---|---|
| 3,078,689 | A * | 2/1963 | Japhet | F25B 6/02 | 62/324.3 |
| 3,132,490 | A * | 5/1964 | Schmidt | F25B 13/00 | 62/155 |
| 3,580,005 | A * | 5/1971 | Hale | F25B 13/00 | 62/149 |
| 4,171,622 | A * | 10/1979 | Yamaguchi | F25B 13/00 | 62/160 |
| 4,240,269 | A * | 12/1980 | Bussjager | F25B 13/00 | 62/324.1 |
| 4,407,137 | A * | 10/1983 | Hayes, Jr. | F25B 13/00 | 62/151 |
| 4,483,156 | A * | 11/1984 | Oudenhoven | F25B 39/00 | 62/324.1 |
| 4,483,165 | A * | 11/1984 | Yasuda | B21B 37/64 | 72/10.4 |
| 5,357,766 | A * | 10/1994 | Shiraishi | F24F 1/0003 | 62/197 |
| 5,381,671 | A * | 1/1995 | Saito | F24F 3/065 | 62/430 |
| 9,416,993 | B2 * | 8/2016 | Hong | F25B 13/00 | |
| 2012/0118533 | A1 * | 5/2012 | Jang | F25B 49/02 | 165/96 |
| 2013/0192809 | A1 * | 8/2013 | Kim | F25B 39/00 | 165/175 |
| 2013/0219944 | A1 | 8/2013 | Song et al. | | |

FOREIGN PATENT DOCUMENTS

| | | | |
|---|---|---|---|
| EP | 2 617 077 | A2 | 7/2013 |
| EP | 2 618 076 | A2 | 7/2013 |
| EP | 2 623 873 | A2 | 8/2013 |
| JP | 2000-146258 | A | 5/2000 |
| JP | 2008-256304 | A | 10/2008 |
| KR | 10-2012-0053730 | A | 5/2012 |
| KR | 10-2013-0085849 | A | 7/2013 |
| KR | 10-2013-0090185 | A | 8/2013 |
| KR | 10-2014-0022319 | A | 2/2014 |

* cited by examiner

AIR CONDITIONER

CROSS-REFERENCE TO RELATED APPLICATIONS

The present application claims priority under 35 U.S.C. 119 to Korean Patent Application No. 10-2014-0099194, filed on Aug. 1, 2014, which is hereby incorporated by reference in its entirety.

BACKGROUND

The present disclosure relates to an air conditioner.

Air conditioners are appliances that maintain indoor air at the most proper state according to use and purpose thereof. In general, such an air conditioner includes a compressor, a condenser, an expansion device, and an evaporator. Thus, the air conditioner has a refrigerant cycle in which compression, condensation, expansion, and evaporation processes of refrigerant are performed to cool or heat a predetermined space.

The predetermined space may be variously provided according to a place at which the air conditioner is used. For example, when the air conditioner is disposed in a home or office, the predetermined space may be an indoor space of a house or building. On the other hand, when the air conditioner is disposed in a vehicle, the predetermined space may be a riding space in which a person rides.

When the air conditioner performs a cooling operation, an outdoor heat exchanger provided in an outdoor unit may serve as a condenser, and an indoor heat exchanger provided in an indoor unit may serve as an evaporator. On the other hand, when the air conditioner performs a heating operation, the indoor heat exchanger may serve as a condenser, and the outdoor heat exchanger may serve as an evaporator.

FIG. 1 is a view of an outdoor heat exchanger according to a related art.

Referring to FIG. 1, an outdoor heat exchanger 1 according to the relates art includes a plurality of refrigerant tubes 2 arranged in a plurality of rows, a coupling plate 3 coupled to an end of each of the refrigerant tubes 2 to support the refrigerant tubes 2, and a header 4 through which refrigerant is divided to flow into the refrigerant tubes 2, or the refrigerant passing through the refrigerant tubes 2 is mixed.

Also, the outdoor heat exchanger 1 may further include a return tube 7 for switching a flow direction of the refrigerant from one refrigerant tube 2 to the other refrigerant tube. For example, the return tube 7 may switch a flow direction of the refrigerant from a refrigerant tube, which is disposed in a first row, of the refrigerant tubes 2 arranged in two rows to a refrigerant tube disposed in a second row.

The outdoor heat exchanger 1 may further include a plurality of distributors 5 and 6. The plurality of distributors 5 and 6 include a first distributor 5 through which the refrigerant is divided and introduced into at least one of the plurality of the refrigerant tubes 2 and a second distributor 6 through which the refrigerant is divided and introduced into the rest of the plurality of refrigerant tubes 2.

In the outdoor heat exchanger 1, the refrigerant flows in directions opposite to each other when cooling and heating operations are performed.

For example, when the air conditioner performs a cooling operation, the outdoor heat exchanger 1 functions as a condenser (see a solid arrow).

In detail, a high-pressure refrigerant compressed by the compressor is introduced into the header 4 and divided to flow into the plurality of refrigerant tubes 2, and the divided refrigerant is heat-exchanged with outdoor air while flowing in the refrigerant tubes 2.

The heat-exchanged refrigerant is mixed in the first and second distributors 5 and 6 to flow toward an indoor heat exchanger.

On the other hand, when the air conditioner performs a heating operation, the outdoor heat exchanger 1 functions as an evaporator (see a dotted arrow).

In detail, refrigerant condensed in the indoor heat exchanger may be decompressed while passing through the expansion device and then be introduced into the outdoor heat exchanger 1. The refrigerant is divided to flow into the first and second distributors 5 and 6 at an inlet-side of the outdoor heat exchanger 1 and introduced into the refrigerant tubes 2 through a plurality of branch tubes respectively connected to the distributors 5 and 6.

Here, the refrigerant may be heat-exchanged with the outdoor air while flowing in the refrigerant tubes 2. The heat-exchanged refrigerant may be mixed in the header 4 to flow to a compressor-side.

When the air conditioner performs the cooling operation, the refrigerant passing through the outdoor heat exchanger 1 is in a high-temperature high-pressure gaseous state. Here, in order to increase condensation efficiency of the refrigerant, the number of branch paths branched into the outdoor heat exchanger 1 may be reduced, and the branch paths may increase in length.

That is, when a flow path of the refrigerant increases in length, the refrigerant increases in flow rate to reduce a condensation pressure, thereby improving condensation efficiency, i.e., a ratio in which the refrigerant changes into gaseous phase.

On the other hand, when the air conditioner performs a heating operation, the refrigerant passing through the outdoor heat exchanger 1 is in a two-phase state. Here, to reduce a pressure loss of the refrigerant, the number of branch paths branched into the outdoor heat exchanger 1 needs to increase, and the length of each of the branch paths needs to shorten.

That is, a gaseous refrigerant of the refrigerant in two-phase has a relatively large pressure loss while flowing However, when the flow path of the refrigerant has a short length, and the number of branch paths increases, the pressure loss, i.e., reduction of an evaporation pressure may be prevented to improve evaporation efficiency.

However, according to the structure of the outdoor heat exchanger according to the related art as illustrated in FIG. 1, when the air conditioner performs the cooling and heating operations, since the branch paths through which the refrigerant is divided to flow into the outdoor heat exchanger have the same number and length, the air conditioner according to the related art may be reduced in heat-exchange efficiency.

That is, when the cooling operation is performed, the condensation pressure in the outdoor heat exchanger increases to deteriorate condensation efficiency. When the heating operation is performed, the evaporation pressure in the outdoor heat exchanger decreases to deteriorate evaporation efficiency.

SUMMARY

Embodiments provide an air conditioner including an outdoor heat exchanger having improved heat-exchange efficiency.

In one embodiment, an air conditioner includes: a compressor; a flow switching part disposed at an outlet-side of the compressor to switch a flow direction of refrigerant according to a cooling or heating operation; an outdoor heat exchanger connected to the flow switching part, the outdoor heat exchanger including a plurality of refrigerant tubes for guiding the refrigerant heat exchanged with outdoor air; a main expansion valve disposed at one side of the outdoor heat exchanger; a first inlet/outlet tube extending from the flow switching part to the outdoor heat exchanger; and a second inlet/outlet tube extending from the outdoor heat exchanger to the main expansion valve, wherein the outdoor heat exchanger includes: a header defining a flow space for the refrigerant, the header including an upper header and a lower header; a check valve disposed between the upper header and the lower header to guide the refrigerant to flow in one direction; and a bypass tube extending from the lower header to the second inlet/outlet tube to guide a discharge of a liquid refrigerant existing in the lower header.

The air conditioner may further include first and second distribution tubes branched from the second inlet/outlet tube, and a plurality of distributors connected to the first and second distribution tubes to allow the refrigerant to be divided and introduced into the plurality of refrigerant tubes.

The plurality of distributors may include: a first distributor connected to the first distribution tube to communicate with the upper header; and a second distributor connected to the second distribution tube to communicate with the lower header.

The air conditioner may further include a plurality of capillary tubes extending from the first and second distributors to the plurality of the refrigerant tubes.

The air conditioner may further include a connection tube extending from the first distribution tube to the lower header to guide the refrigerant in the first distribution tube to the lower header when the cooling operation is performed.

The air conditioner may further include a first valve disposed in the first distribution tube; and a second valve disposed in the second distribution tube.

The air conditioner may further include a third valve disposed in the connection tube.

The bypass tube may extend from the lower header and is connected to the second inlet/outlet tube by being bent at least two times.

The bypass tube may extend from a bottom surface of the lower header.

The air conditioner may further include a plurality of refrigerant inflow tubes extending from the lower header to the plurality of refrigerant tubes, wherein the uppermost portion of the bypass tube 250 may have a height (H1) lower than that (H2) of the lowermost inflow tube of the plurality of refrigerant inflow tubes.

The height (H1) of the uppermost portion of the bypass tube may be higher than that (H3) of the bottom surface of the lower header.

In another embodiment, an air conditioner includes: a compressor; a flow switching part disposed at an outlet-side of the compressor to switch a flow direction of refrigerant according to a cooling or heating operation; an outdoor heat exchanger connected to the flow switching part, the outdoor heat exchanger including a plurality of refrigerant tubes for guiding the refrigerant heat exchanged with outdoor air; a main expansion valve disposed at one side of the outdoor heat exchanger; a first inlet/outlet tube extending from the flow switching part to the outdoor heat exchanger; and a second inlet/outlet tube extending from the outdoor heat exchanger to the main expansion valve, wherein the outdoor heat exchanger includes: a header defining a flow space for the refrigerant, the header including an upper header and a lower header; a plurality of refrigerant inflow tubes extending from the header to the plurality of refrigerant tubes; and a bypass tube extending from the lower header to an outlet-side of the outdoor heat exchanger and having a bent part.

The bent part of the bypass tube may include: a first bent part for changing an extension direction of the bypass tube from a lower side to an upper side; and a second bent part for changing the extension direction of the bypass tube from the upper side to the lower side.

The air conditioner may further include a first extension part extending downward from a lower portion of the lower header; and a second extension part extending upward from the first extension part, wherein the first bent part may be disposed between the first extension part and the second extension part.

The air conditioner may further include a third extension part extending downward from the second extension part, wherein the second bent part may be disposed between the second extension part and the third extension part.

The second bent part may have a height (H1) lower than that (H2) of the lowermost inflow tube of the plurality, of refrigerant inflow tubes and higher than that (H3) of a bottom surface of the lower header.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Hereinafter, reference will now be made in detail to the embodiments of the present invention, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the inventive concept will fully convey the concept of the invention to those skilled in the art.

Figure 1:
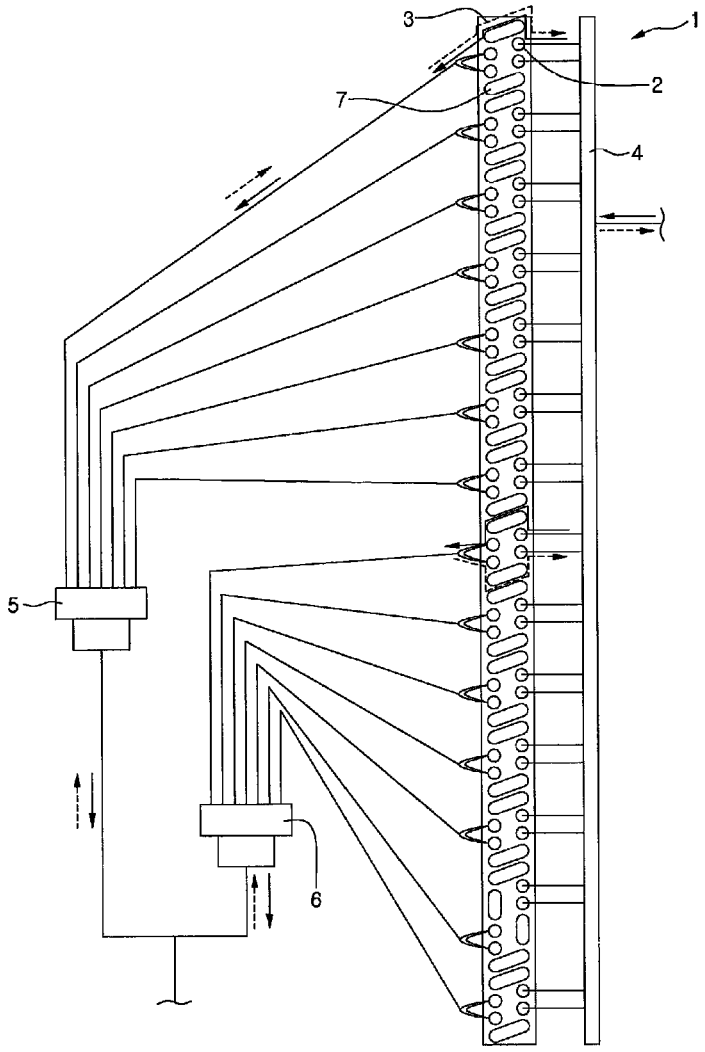
FIG.1 RELATED ART
FIG. 1 is a view of an outdoor heat exchanger according to a related art.
Figure 2:
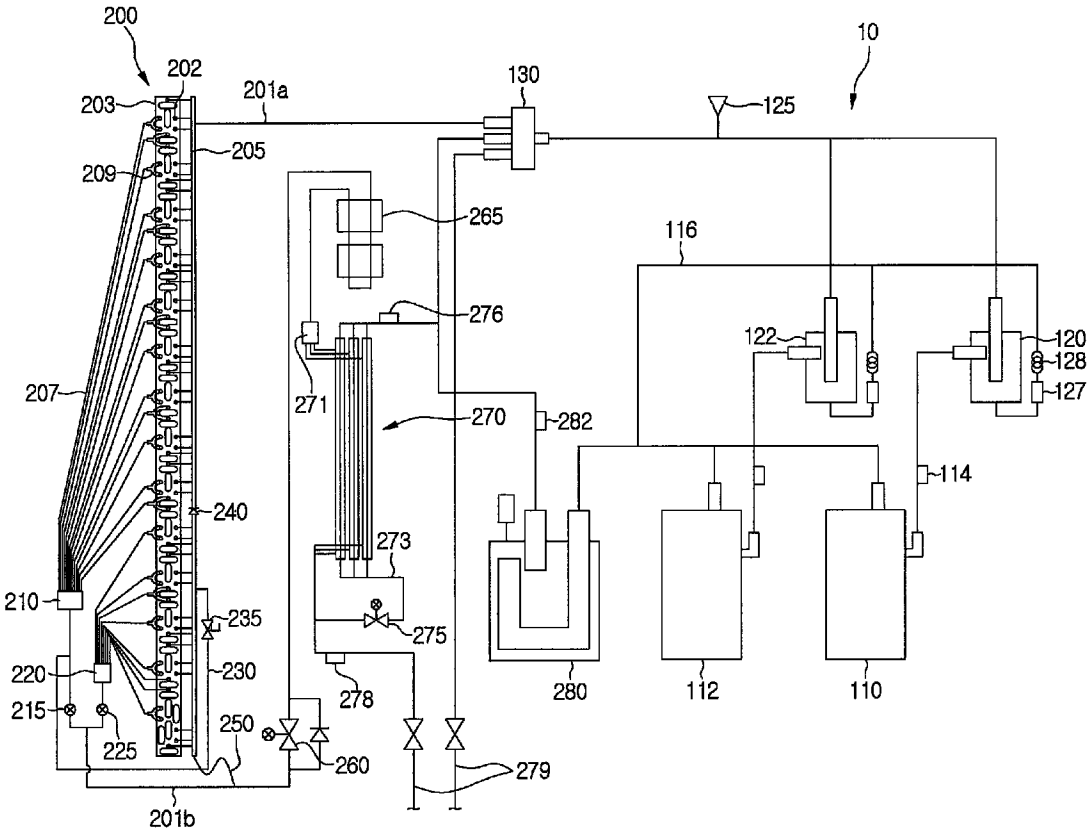
FIG. 2 is a system view of an air conditioner according to an embodiment.
Figure 3:
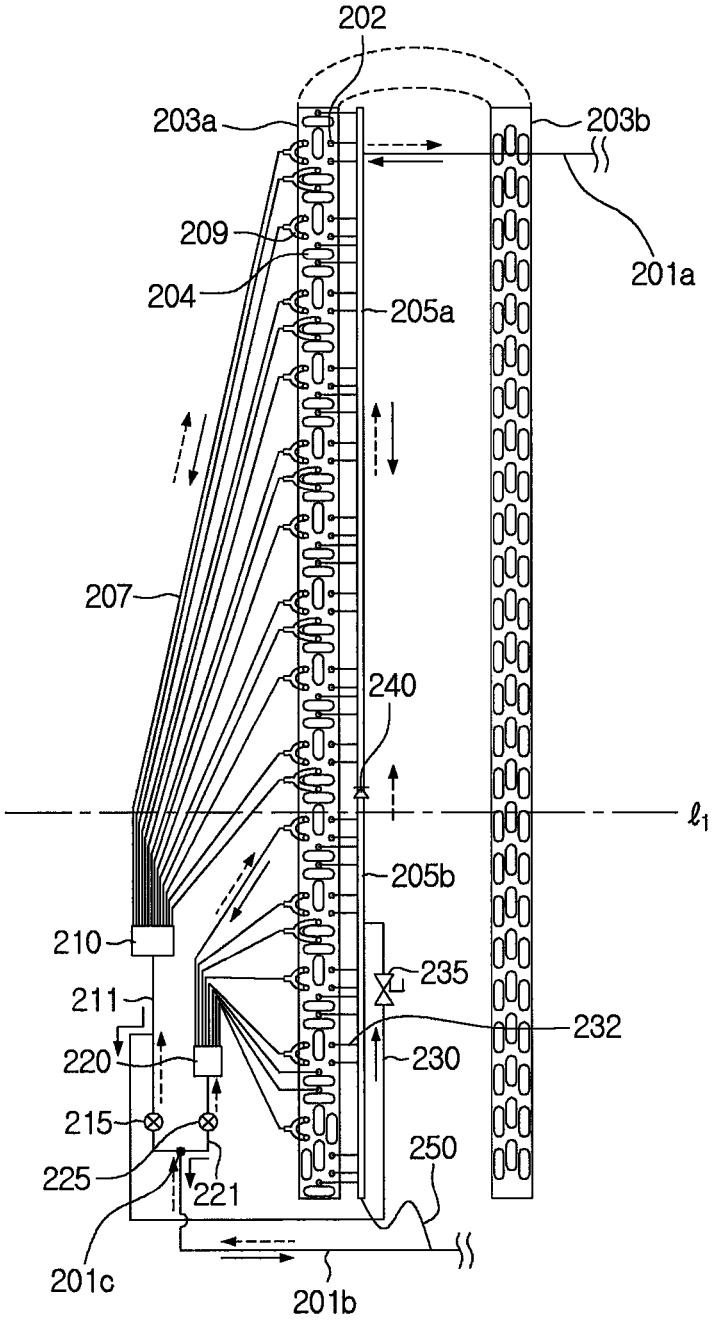
FIG. 3 is a view of main components of an outdoor heat exchanger according to an embodiment.

FIG. 2 is a system view of an air conditioner according to an embodiment, and FIG. 3 is a view of main components of an outdoor heat exchanger according to an embodiment.

Referring to FIG. 2, an air conditioner 10 according to an embodiment includes an indoor unit disposed indoors and an outdoor unit disposed outdoors. The indoor unit includes an indoor heat exchanger in which air in an indoor space is heat-exchanged. In FIG. 2, a configuration of the outdoor unit is illustrated.

The air conditioner 10 includes a plurality of compressors 110 and 112 and oil separators 120 and 122 disposed at an outlet-side of each of the plurality of compressors 110 and 112 to separate the oil from the refrigerant discharged from each of the plurality of compressors 110 and 112.

The plurality of compressors 110 and 112 include a first compressor 110 and a second compressor 112, which are connected in parallel to each other. A discharge temperature sensor 114 for detecting a temperature of the compressed refrigerant may be disposed at an outlet-side of each of the first and second compressors 110 and 112.

Also, the oil separators 120 and 122 include a first oil separator 120 disposed at the outlet-side of the first compressor 110 and a second oil separator 122 disposed at the outlet-side of the second compressor 112.

The air conditioner 10 includes a collection passage 116 for collecting the oil from the oil separators 120 and 122 into the compressors 110 and 112. The collection passage 116 may extend from each of the outlet-sides of the first and second oil separators 120 and 122 and then combined with each other. Here, the combined passage may be connected to an inlet-side tube of each of the first and second compressors 110 and 112.

A dryer 127 and a capillary 128 may be disposed in the collection passage 116.

A high-pressure sensor 125 for detecting a discharge pressure of the refrigerant discharged from the compressors 110 and 112 and a flow switching part 130 for guiding the refrigerant passing through the high-pressure sensor 125 to the outdoor heat exchanger 200 or the indoor unit are disposed on the outlet-sides of the oil separators 120 and 122. For example, the flow switching part 130 may include a four-way valve.

When the air conditioner performs a cooling operation, the refrigerant may be introduced from the flow switching part 130 into the outdoor heat exchanger 200. On the other hand, when the air conditioner performs a heating operation, the refrigerant may flow from the flow switching part 130 into an indoor heat exchange-side of the indoor unit (not shown).

When the air conditioner performs a cooling operation, the refrigerant condensed in the outdoor heat exchanger 200 passes through a main expansion valve 260 (an electronic expansion valve). Here, the main expansion valve 260 is completely opened, and thus the refrigerant is not decompressed. That is, the main expansion valve 260 may be disposed at the outlet-side of the outdoor heat exchanger 200 in a cooling mode.

The refrigerant passing through the main expansion valve 260 passes through a heat dissipation plate 265. The heat dissipation plate 265 may be provided in an electronic unit in which heat generation components are disposed.

For example, the heat generation component may include a power module (e.g., an intelligent power module (IPM)). The IPM may be understood as a module in which a driving circuit of a power device such as a power MOSFET or IGBT and a protection circuit having a self protection function is installed.

The condensed refrigerant is coupled to the heat dissipation plate 265 to cool the heat generation component.

The air conditioner 10 may further include a supercooling heat exchanger 270 in which the refrigerant passing through the heat-dissipation plate 265 is introduced and a supercooling distributor 271 disposed on an inlet-side of the supercooling heat exchanger 270 to divide the refrigerant. The supercooling heat exchanger 270 may serve as an intermediate heat exchanger in which a first refrigerant circulated into the system and a portion (a second refrigerant) of the first refrigerant are heat-exchanged with each other after the refrigerant is divided.

Here, the first refrigerant may be a refrigerant that is introduced into the supercooling heat exchanger 270 via the supercooling distributor 271 and thus be supercooled by the second refrigerant. On the other hand, the second refrigerant may absorb heat from the first refrigerant.

The air conditioner 10 includes a supercooling passage 273 disposed at an outlet-side of the supercooling heat exchanger 270 to divide the second refrigerant from the first refrigerant.

Also, a supercooling expansion device 275 for decompressing the second refrigerant may be disposed in the supercooling passage 273. The supercooling expansion device 275 may include the electric expansion valve (EEV).

The second refrigerant of the supercooling passage 273 may be introduced into the supercooling heat exchanger 270 and then be heat-exchanged with the first refrigerant to flow to an inlet-side of a gas/liquid separator 280. The air conditioner may further include a supercooling discharge temperature sensor 276 for detecting a temperature of the second refrigerant passing through the supercooling heat exchanger 270.

The gas/liquid separator 280 may be configured to separate a gaseous refrigerant from the refrigerant before the refrigerant is introduced into the compressors 110 and 112. The separated gaseous refrigerant may be introduced into the compressors 110 and 112.

While the refrigeration cycle is driven, the evaporated refrigerant may be introduced into the gas/liquid separator 280 via the flow switching part 130. Here, the evaporated refrigerant may be mixed with the second refrigerant passing through the supercooling heat exchanger 270 and then be introduced into the gas/liquid separator 280.

A suction temperature sensor 282 for detecting a temperature of the refrigerant to be suctioned into the compressors 110 and 112 may be disposed at the inlet-side of the gas/liquid separator 280.

The first refrigerant passing through the supercooling heat exchanger 270 may be introduced into the indoor unit through an indoor unit connection tube 279. The air conditioner may further include a liquid tube temperature sensor 278 disposed at the outlet-side of the supercooling heat exchanger 270 to detect a temperature of the first refrigerant passing through the supercooling heat exchanger 270, i.e., a temperature of the supercooled refrigerant.

Hereinafter, the outdoor heat exchanger 200 and peripheral components thereof will be described.

The air conditioner 10 includes a first inlet/outlet tube 201*a* connected from the flow switching part 130 to one side of the outdoor heat exchanger 200 and a second inlet/outlet tube 201*b* extending from the other side of the outdoor heat exchanger 200 to the main expansion device 260.

For example, the first inlet/outlet tube 201*a* may be connected to an upper portion of the header 205, i.e., an upper header 205*a*, and the second inlet/outlet tube 201*b* may be connected to a lower portion of the header 205, i.e., a lower header 205*b*.

When the air conditioner 10 performs a cooling operation, the refrigerant is introduced into the outdoor heat exchanger 200 through the first inlet/outlet tube 201*a* and is discharged from the outdoor heat exchanger 200 through the second inlet/outlet tube 201*b*.

On the other hand, when the air conditioner 10 performs a heating operation, the refrigerant is introduced into the outdoor heat exchanger 200 through the second inlet/outlet tube 201*b* and is discharged from the outdoor heat exchanger 200 through the first inlet/outlet tube 201*a*.

The outdoor heat exchanger 200 includes a refrigerant tube 202 having a plurality of rows and stages. For example, the refrigerant tube 202 may be provided in plurality so that the plurality of refrigerant tubes 202 are arranged in two rows in a horizontal direction and stepped in plural stages in a vertical direction.

The plurality of refrigerant tubes 202 may be bent to lengthily extend. For example, in FIG. 3, the plurality of refrigerant tubes 202 may extend to a rear side of the ground and then extend forward. In this case, each of the plurality of refrigerant tubes 202 may have a U-shape.

The outdoor heat exchanger 200 may include a coupling plate 203 for supporting the refrigerant tubes 202. The coupling plate 203 includes a first plate 203*a* having a bent shape to support one side of the refrigerant tubes 202 and a second plate 203*b* supporting the other side of the refrigerant tubes 202. Each of the first and second plates 203*a* and 203*b* lengthily extends in a vertical direction.

The outdoor heat exchanger 200 may further include a return tube 204 coupled to ends of the plurality of refrigerant tubes 202 to guide refrigerant flowing in one refrigerant tube 202 to the other refrigerant tube 202. The return tube 204 is provided in plurality and is coupled to one side of each of the first and second plates 203*a* and 203*b*.

The outdoor heat exchanger 200 may further include the header 205 defining a flow space of the refrigerant. Through the header 205, the refrigerant is divided and introduced into the plurality of refrigerant tubes 202, or the refrigerant heat-exchanged in the plurality of refrigerant tubes 202 is mixed with each other. The header 205 lengthily extends in a vertical direction to correspond to a direction in which the first plate 203*a* extends.

A plurality of refrigerant inflow tubes 232 extend between the header 205 and the first plate 203*a*. Each of the plurality of refrigerant inflow tubes 232 extends from the header 205 and then is connected to the refrigerant tube 202 supported by the first plate 203*a*. Also, the plurality of refrigerant inflow tubes 232 may be vertically spaced apart from each other.

When the air conditioner performs a cooling operation, the refrigerant in the header 205 may be introduced into the refrigerant tubes 202 through the plurality of refrigerant inflow tubes 232. On the other hand, when the air conditioner performs a heating operation, the refrigerant in the refrigerant tubes 202 may be introduced into the header 205 through the refrigerant inflow tube 232.

The air conditioner 10 may further include a plurality of distributors 210 and 220 for dividing and introducing the refrigerant into the outdoor heat exchanger 200 when the heating operation is performed. The plurality of distributors 210 and 220 include the first distributor 210 and the second distributor 220.

Also, the air conditioner 10 may further include a first distribution tube 211 and a second distribution tube 221 branched from the second inlet/outlet tube 201*b* to the first distributor 210 and the second distributor 220. The first and second distribution tubes 211 and 221 may extend from a branch portion 201*c* to the first and second distributors 210 and 220.

The air conditioner 10 may further include a first valve 215 disposed in the first distribution tube 211 to adjust a refrigerant flow rate flowing in the first distribution tube 211 and a second valve 225 disposed in the second distribution tube 221 to adjust a refrigerant flow rate flowing in the second distribution tube 221.

Each of the first and second valves 215 and 225 may include an electric expansion valve (EEV) of which an opened degree is adjustable.

The air conditioner 10 may further include a plurality of capillary tubes 207 extending from the first and second distributors 210 and 220 to the plurality of refrigerant tubes 202. When the air conditioner 10 performs a heating operation, the refrigerant is divided to flow into the first and second distributors 210 and 220, and the divided refrigerant moves into the refrigerant tubes 202 through the plurality of capillary tubes 207.

The air conditioner 10 may further include a branch tube 209 connecting each of the plurality of capillary tubes 207 to the refrigerant tube 202. The branch tube 209 may divide the refrigerant flowing in the capillary tube 207 in two directions, into one refrigerant tube 202 and the other refrigerant tube 202. For example, the branch tube 209 may include a branch tube having a Y shape. The branch tube 209 may be provided in plurality to correspond to the number of the plurality of capillary tubes 207.

When the air conditioner 10 performs a heating operation, the refrigerant introduced into the refrigerant tubes 202 through the plurality of capillary tubes 207 connected to the first distributor 210 is heat-exchanged and introduced into the upper header 205*a* of the header 205. Also, the refrigerant introduced into the refrigerant tubes 202 through the plurality of capillary tubes 207 connected to the second distributor 220 is heat-exchanged and introduced into the lower header 205*b* of the header 205.

That is, the header 205 includes the upper header 205*a* communicating with the first distributor 210 and the lower header 205*b* communicating with the second distributor 220. A virtual partition line l 1 partitioning the upper header 205*a* from the lower header 205*b* is illustrated in FIG. 3.

The air conditioner 10 may further include a check valve 240 disposed between the upper header 205*a* and the lower header 205*b*. The check valve 240 may allow the refrigerant to flow from the lower header 205*b* to the upper header 205*a* and may restrict the flow of the refrigerant from the upper header 205*a* to the lower header 205*b*.

Thus, when the air conditioner 10 performs the heating operation, the refrigerant introduced into the refrigerant tube 202 through the second distributor 220 may be heat-exchanged and then be introduced into the lower header 205*b*. The refrigerant introduced into the lower header 205*b* may be guided by the check valve 240 to flow to the upper header 205*a*. Also, the refrigerant introduced into the refrigerant tube 202 through the first distributor 210 may be heat-exchanged and introduced into the upper header 205*a* and then be mixed with the refrigerant introduced from the lower header 205*b* to move to the first inlet/outlet tube 201*a*.

The air conditioner 10 may further include a connection tube 230 extending from one spot of the first distribution tube 211 to the lower header 205*b*. In the connection tube 230, a third valve 235 for adjusting a refrigerant flow rate within the connection tube 230 may be disposed. For example, the third valve 235 may include an on/off controllable solenoid valve and an EEV of which an opened degree is adjustable.

When the air conditioner performs a cooling operation, the refrigerant flowing from the first distributor 210 to the first distribution tube 211 may be introduced into the lower header 205*b* through the connection tube 230.

The air conditioner 10 may further include a bypass tube 250 extending from a lower end of the header 205, i.e., a lower end of the lower header 205*b* to the second inlet/outlet tube 201*b*. When the air conditioner 10 performs a cooling operation, the bypass tube 250 may allow a liquid refrigerant collected in a lower portion of the header 205 to be bypassed toward the second inlet/outlet tube 201*b*, i.e., the outlet-side of the outdoor heat exchanger 200.

Hereinafter, a heating operation of the air conditioner and flow of the refrigerant in the air conditioner in a cooling mode will be described with reference to FIGS. 2 and 3.

First, when the air conditioner performs a heating operation, oil is separated from the high-temperature and high-pressure refrigerant compressed by the first and second compressors 110 and 112 via the first and second oil separators 120 and 122, and the separated oil is returned into the first and second compressors 110 and 112 through the collection passage 116. Also, the refrigerant from which the oil is separated flows toward the indoor unit via the flow switching part 130.

The refrigerant introduced into the indoor unit is condensed in the indoor heat exchanger. The condensed refrigerant is introduced into the supercooling heat exchanger 270 through the indoor connection tube 279. Here, a portion of the refrigerant may be divided to flow into a supercooling passage 273 and decompressed in a supercooling expansion device 275 and then be introduced into a supercooling heat exchanger 270.

Thus, the condensed refrigerant may be heat-exchanged with the refrigerant flowing through the supercooling passage 273 to supercool the condensed refrigerant.

The supercooling refrigerant passing through the supercooling heat exchanger 270 may cool the heat generating component of the electronic unit while passing through the heat dissipation plate 265 and then be decompressed in the main expansion valve 260.

The decompressed refrigerants may be divided to flow into the first and second distribution tubes 211 and 221 at the branch portion 201*c* and then be respectively introduced into the first and second distributors 210 and 220. Here, each of the first and second valves 215 and 225 may be opened over a preset opening degree. For example, the first and second valves 215 and 225 may be completely opened.

The refrigerant flowing into the first distributor 210 is introduced into the refrigerant tube 202 via the plurality of capillary tubes 207 and then is introduced into the upper header 205*a* after being heat-exchanged. Also, the refrigerant flowing into the second distributor 220 is introduced into the refrigerant tube 202 via the plurality of capillary tubes 207 and then is introduced into the lower header 205*b* after being heat-exchanged. Here, the refrigerant may be evaporated in the heat-exchange process.

The refrigerant introduced into the lower header 205*b* flows into the upper header 205*a* and then is mixed with the refrigerant introduced into the upper header 205*a*. Here, the refrigerant in the lower header 205*b* may flow into the upper header 205*a* via the check valve 240 (see a dotted arrow).

The mixed refrigerant may be discharged to the first inlet/outlet tube 201*a* connected to the upper header 205*a*, and the gaseous refrigerant introduced into the gas/liquid separator 280 via the flow switching part 130 and then separated by the gas/liquid separator 280 may be absorbed into the first and second compressors 110 and 112. This refrigeration cycle may be repeatedly performed.

Like this, when the air conditioner 10 performs a heating operation, the refrigerant may be introduced into the outdoor heat exchanger 200 through the first and second distributors 210 and 220 and heat-exchanged by using all of the passages at the first and second distributors sides.

Thus, the flow path of the refrigerant in the outdoor heat exchanger 200 is reduced in length, and the number of paths branched into the outdoor heat exchanger 200 increases. As a result, the pressure loss of the refrigerant may be reduced to prevent an evaporation pressure from being reduced, thereby improving evaporation efficiency.

When the air conditioner performs a cooling operation, oil is separated from the high-temperature and high-pressure refrigerant compressed by the first and second compressors 110 and 112 via the first and second oil separators 120 and 122, and the separated oil is returned into the first and second compressors 110 and 112 through the collection passage 116. Also, the refrigerant from which the oil is separated flows into the first inlet/outlet tube 201*a* via the flow switching part 130 and then is introduced into the header 205 of the outdoor heat exchanger 200.

The refrigerant introduced into the header 205 exists in the upper header 205*a*, and the introduction of the refrigerant into the lower header is restricted by the check valve 240.

The refrigerant of the upper header 205*a* is introduced into the refrigerant tube 202 fixed to the first plate 203*a* through the plurality of refrigerant inflow tubes 232. The refrigerant of the refrigerant tube 202 is heat-exchanged and flows into the plurality of capillary tubes 207 through the branch tube 209. Here, the refrigerant may be primarily condensed in the heat-exchange process.

The refrigerant of the plurality of capillary tubes 207 is combined with each other in the first distributor 210 and is introduced into the lower header 205*b* through the first distribution tube 211 and the connection tube 230. Here, the first valve 215 is closed to restrict flow of the refrigerant into the branch portion 201*c*. Also, the third valve 235 is turned on or opened over a preset opened degree to allow the refrigerant to flow into the connection tube 230.

The refrigerant introduced into the lower header 205*b* flows into the plurality of refrigerant tubes 202 fixed to the first plate 203*a* via the plurality of refrigerant inflow tubes 232. Also, the refrigerant may be secondarily condensed in the process in which the refrigerant flows through the plurality of refrigerant tubes 202.

The secondarily condensed refrigerant is introduced into the second distributor 220 via the branch tubes 209 and the plurality of the capillary tubes 207. The refrigerant of the second distributor 220 flows through the second inlet/outlet passage 201*b* via the second distribution tube 221 and the branch portion 201*c* and is discharged from the outdoor heat exchanger 200.

The refrigerant discharged from the outdoor heat exchanger 200 may flow toward the indoor unit via the heat dissipation plate 265 and the supercooling heat exchanger 270. The refrigerant may be expanded and evaporated in the indoor unit and then be absorbed into the first and the second compressors 110 and 120 via the flow switching part 130 and the gas/liquid separator 280. This refrigeration cycle may be repeatedly performed.

Like this, when the air conditioner 10 performs a cooling operation, the refrigerant introduced into the outdoor heat exchanger 200 may be primarily condensed in the refrigerant tube 202 connected at an upper header 205*a* side and be secondarily condensed in the refrigerant tube 202 connected to at a lower header 205*b* side. Thus, while the flow path of the refrigerant increases in length, the number of paths branched into the refrigerant tubes 202 is reduced. As a result, the refrigerant may increase in flow rate to reduce a condensation pressure, thereby improving condensation efficiency.

A liquid refrigerant may be filled in the lower header 205*b*. In detail, since the refrigerant is primarily condensed while flowing through the refrigerant tube 202 connected to the upper header 205*a*, the refrigerant may be in a two-phase state. Thus, the refrigerant introduced into the lower header 205*b* through the connection tube 230 may include a gaseous phase and a liquid phase.

Since the liquid refrigerant has a specific gravity greater than the gaseous refrigerant, the liquid refrigerant may be filled in a lower side of the lower header 205*b*. The liquid refrigerant may be understood as a completely condensed refrigerant that does not need to be heat-exchanged any more. Thus, when the liquid refrigerant is introduced into the refrigerant tube 202 and heat-exchanged, the outdoor heat exchanger may be deteriorated in heat-exchange performance, and also pressure loss due to the liquid refrigerant may occur.

Thus, the current embodiment provides the bypass tube 250 for allowing the liquid refrigerant to be bypassed toward the outlet of the outdoor heat exchanger 200. The bypass tube 250 extends from the lower header 205*b* to the second inlet/outlet tube 201*b* to discharge the refrigerant collected in the lower header 205*b* to the second inlet/outlet tube 201*b*.

Hereinafter, a configuration of the bypass tube 250 will be described below with reference to FIG. 4.

Figure 4:
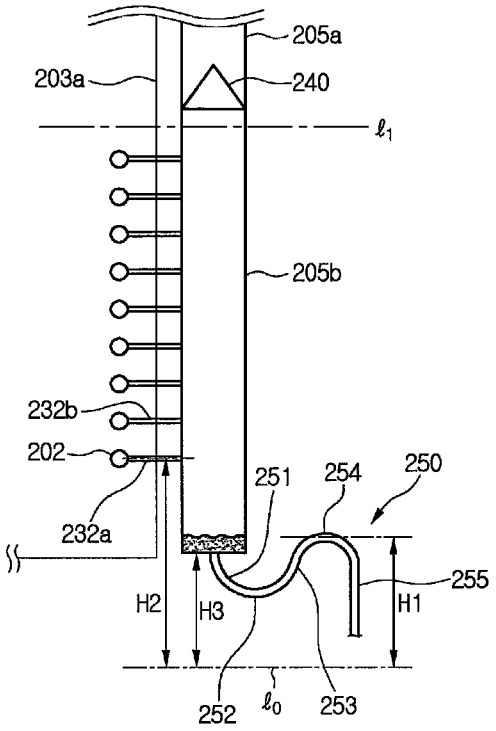
FIG. 4 is a schematic view illustrating a bypass tube of the outdoor heat exchanger according to an embodiment.

FIG. 4 is a schematic view illustrating a bypass tube of the outdoor heat exchanger according to an embodiment.

Referring to FIG. 4, the outdoor heat exchanger 200 according to the embodiment includes the bypass tube 250 for allowing the liquid refrigerant existing in the header 205 to be bypassed toward the outlet of the outdoor heat exchanger 200.

The bypass tube 250 extends from the lower portion of the lower header 205*b* of the header 205 toward the second inlet/outlet tube 201*b*. The bypass tube 250 may be curved or bent at least two times.

In detail, the bypass tube 250 includes a first extension part 251 extending downward from the lower portion of the lower header 205*b*. For example, the first extension part 251 may extend downward from a bottom surface of the lower header 205*b*.

The bypass tube 250 may further include a second extension part 253 extending upward from the first extension part 251 and a first bent part 252 disposed at one spot between the first extension part 251 and the second extension part 253 to switch an extension direction of the bypass tube 250.

The bypass tube 250 may further include a third extension part 255 extending downward from the second extension part 253 and a second bent part 254 disposed at one spot between the second extension part 253 and the third extension part 255 to switch the extension direction of the bypass tube 250.

The bypass tube 250 includes at least two switching parts 252 and 254 for switching the extension direction of the bypass tube 250. The first bent part 252 may switch the extension direction of the bypass tube 250 from a lower side to an upper side, and the second bent part 254 may switch the extension direction of the bypass tube 250 from the upper side to the lower side.

The outdoor heat exchanger 200 according to the current embodiment includes the plurality of refrigerant inflow tubes 232 extending from the lower header 205*b* to the plurality of refrigerant tubes 202. The plurality of refrigerant inflow tubes 232 includes a lowermost inflow tube 232*a* disposed at the lowest position thereof and a plurality of upper inflow tubes 232*b* disposed at an upper side of the lowermost inflow tube 232*a*.

The bypass tube 250 may have a structure in which a pressure of the refrigerant flowing in the bypass tube 250 is less than that of the refrigerant in the lowermost inflow tube 232*a*.

For this, the lowermost inflow tube 232*a* may have a height H2 higher than a height H1 of an uppermost portion of the bypass tube 250. Here, the heights H1 and H2 may be understood as distances from the reference line l o. For example, the reference line l o may be a base forming a lower portion of the outdoor unit or the ground.

The height H1 of the uppermost portion of the bypass tube 250 may correspond to a height of the second bent part 254 of the bypass tube 250.

Like this, since the height H1 of the uppermost portion of the bypass tube 250 is lower than the height H2 of the lowermost inflow tube 232*a*, a pressure of the refrigerant in the lowermost inflow tube 232*a* may be greater than that in the bypass tube 250. Thus, introduction of the liquid refrigerant existing in the lower header 205*b* into the lowermost tube 232*a* may be prevented.

Also, the bypass tube 250 may have a structure in which the gaseous refrigerant existing in the lower header 205*b* is not discharged into the bypass tube 250. Thus, the height H1 of the uppermost portion of the bypass tube 250 may be higher than a H3 of the bottom surface of the lower header 205*b*. The height H3 may be understood as a distance from the reference line l o.

Since the height H1 is higher than the height H3, a discharge of all of the liquid refrigerant existing in the lower header 205*b* through the bypass tube 250 may be restricted. Also, a level of the liquid refrigerant existing in the lower header 205*b* may correspond to the height H1 of the uppermost portion of the bypass tube 250. Thus, discharge of the gaseous refrigerant of the lower header 205*b* through the bypass tube 250 may be prevented.

According to the above-described structure, the bypass tube 250 is provided to allow the liquid refrigerant existing in the lower header 205*b* to be bypassed toward the outlet of the outdoor heat exchanger 200, thereby improving heat exchange performance of the outdoor heat exchanger 200.

Also, since the height H1 is lower than the height H2 and is higher than the height H3, introduction of the liquid refrigerant into the refrigerant inflow tube 232 may be prevented, and also a phenomenon in which the gaseous refrigerant existing in the lower header 205*b* is discharged through the bypass tube 250 may be prevented.

According to the embodiment, when the air conditioner performs the cooling and heating operations, since the paths through which the refrigerant passes through the outdoor heat exchanger are different in number and length, the outdoor heat exchanger may be improved in heat exchange efficiency.

In detail, when the air conditioner performs the cooling operation, since the number of paths through which the refrigerant is introduced into the outdoor heat exchanger is reduced, and the length of the path increases, the refrigerant may increase in flow rate to decrease the condensation pressure, thereby improving the condensation efficiency.

Also, when the air conditioner performs the heating operation, since the number of paths through which the refrigerant is introduced into the outdoor heat exchanger increases, and the length of the path is reduced, the refrigerant may be reduced in pressure loss to prevent the evaporation pressure from being reduced, thereby improving the evaporation efficiency.

Also, since the bypass tube for allowing the liquid refrigerant to be bypassed toward the outlet-side of the outdoor heat exchanger is provided at the lower side of the header of the outdoor heat exchanger, the phenomenon in which the liquid refrigerant is concentrated into the lower side of the header may be prevented.

As a result, since the liquid refrigerant that is already condensed and not be heat-exchanged is discharged from the outdoor heat exchanger, the outdoor heat exchanger may be improved in heat exchange performance (the condensation performance) to prevent pressure loss due to the liquid refrigerant from occurring.

Also, since the refrigerant flowing in the bypass tube has a pressure less than that of the refrigerant in the lowermost inflow tube of the header, the level of the liquid refrigerant may be disposed at the lower side of the lowermost inflow tube, and thus, the introduction of the liquid refrigerant into the lowermost inflow tube may be prevented.

Also, because the height of the uppermost portion of the bypass tube is higher than that of the lower end of the header, the liquid refrigerant within the header may be maintained over a predetermined level, and thus the discharge of the gaseous refrigerant from the outdoor heat exchanger through the bypass tube may be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a compressor;

a flow switching part disposed at an outlet-side of the compressor to switch a flow direction of refrigerant according to a cooling or heating operation;

an outdoor heat exchanger;

an expansion valve;

a first inlet/outlet tube extending from the flow switching part to the outdoor heat exchanger; and a second inlet/outlet tube extending from the outdoor heat exchanger to the expansion valve, wherein the outdoor heat exchanger comprises:

a plurality of refrigerant tubes for guiding the refrigerant to be heat exchanged with outdoor air;

a header defining a flow space for the refrigerant, the header comprising an upper header and a lower header; and a bypass tube extending from the lower header to an outlet side of the outdoor heat exchanger to guide a discharge of a liquid refrigerant existing in the lower header to the outlet side of the outdoor heat exchanger, wherein the bypass tube is configured to allow a liquid refrigerant collected in the lower header to be bypassed toward the second inlet/outlet tube when the cooling operation is performed.

2. The air conditioner according to claim 1, further comprising:

a first distribution tube branched from the second inlet/outlet tube;

a first distributor connected to the first distribution tube;

a second distribution tube branched from the second inlet/outlet tube; and a second distributor connected to the second distribution tube, wherein the first distributor and the second distributor allow the refrigerant to be divided and introduced into the plurality of refrigerant tubes.

3. The air conditioner according to claim 2, wherein the first distributor communicates with the upper header, and wherein the second distributor communicates with the lower header.

4. The air conditioner according to claim 3, further comprising a plurality of capillary tubes extending from the first distributor and the second distributor to the plurality of refrigerant tubes.

5. The air conditioner according to claim 2, further comprising a connection tube extending from the first distribution tube to the lower header to guide the refrigerant in the first distribution tube to the lower header when the cooling operation is performed.

6. The air conditioner according to claim 5, further comprising a valve disposed in the connection tube.

7. The air conditioner according to claim 2, further comprising:

a first valve disposed in the first distribution tube; and a second valve disposed in the second distribution tube.

8. The air conditioner according to claim 1, wherein the bypass tube extends from the lower header and is connected to the second inlet/outlet tube, and wherein the bypass tube includes at least two bends.

9. The air conditioner according to claim 8, wherein the bypass tube extends from a bottom surface of the lower header.

10. The air conditioner according to claim 1, further comprising a plurality of refrigerant inflow tubes extending from the lower header to the plurality of refrigerant tubes.

11. The air conditioner according to claim 10, wherein an uppermost portion of the bypass tube has a height lower than a height of a lowermost inflow tube of the plurality of refrigerant inflow tubes.

12. The air conditioner according to claim 11, wherein the height of the uppermost portion of the bypass tube is higher than a height of a bottom surface of the lower header.

13. The air conditioner according to claim 10, wherein the bypass tube includes a bent part, the bent part comprising:

a first bent part for changing an extension direction of the bypass tube from a lower side to an upper side; and a second bent part for changing the extension direction of the bypass tube from the upper side to the lower side.

14. The air conditioner according to claim 13, further comprising a first extension part extending downward from a lower portion of the lower header; and a second extension part extending upward from the first extension part, wherein the first bent part is disposed between the first extension part and the second extension part.

15. The air conditioner according to claim 14, further comprising a third extension part extending downward from the second extension part, wherein the second bent part is disposed between the second extension part and the third extension part.

16. The air conditioner according to claim 13, wherein the second bent part has a height lower than a height of a lowermost inflow tube of the plurality of refrigerant inflow tubes and higher than a height of a bottom surface of the lower header.

17. The air conditioner according to claim 1, further comprising:

a valve disposed between the upper header and the lower header.

18. The air conditioner according to claim 17, wherein the valve is a check valve to guide the refrigerant to flow in only one direction.

19. The air conditioner according to claim 1, wherein the bypass tube extends from the lower header to the second inlet/outlet tube.

* * * * *